United States Patent [19]

Day

[11] Patent Number: 4,735,025

[45] Date of Patent: Apr. 5, 1988

[54] SLIDE MECHANISM FOR AN IMPROVED BIND-FREE, EXPANDABLE STRUCTURAL FRAME

[75] Inventor: Robert H. Day, Sun Valley, Calif.

[73] Assignee: S.D.S. Industries, Inc., Pacoima, Calif.

[21] Appl. No.: 14,335

[22] Filed: Feb. 13, 1987

[51] Int. Cl.[4] ..... F06B 1/04

[52] U.S. Cl. ..... 52/217

[58] Field of Search ..... 52/211, 212, 217; 49/505

[56] References Cited

U.S. PATENT DOCUMENTS

| | | | |
|---|---|---|---|
| 2,711,564 | 6/1955 | Jackson | 49/505 X |
| 2,742,117 | 4/1956 | Tolman | 49/505 X |
| 2,853,161 | 9/1958 | Mascari | 52/217 X |
| 3,808,759 | 5/1974 | Carmichael | 52/212 |
| 3,906,671 | 9/1975 | Maldonado | 52/212 X |
| 4,395,855 | 8/1983 | Juker | 52/212 |

*Primary Examiner*—Carl D. Friedman

*Attorney, Agent, or Firm*—Leonard Tachner

[57] ABSTRACT

A slide mechanism for providing non-binding adjustment of the spacing between the components of an elongated structural member such as the vertical and horizontal frame members of a door or window frame for accommodating different buck widths during installation. The slide mechanism comprises a channel member and a tongue member adapted to slideably engage one another in loosely fitting relation to preclude binding during width adjustment. Each frame member is preferably provided with at least two such sliding mechanisms of which preferably one provides a dimpled channel member for assuring precise transverse registry of the frame components. By dimpling only one such channel member, a degree of non-binding angular or rotational motion between frame components is provided to facilitate easy installation.

8 Claims, 4 Drawing Sheets

SLIDE MECHANISM FOR AN IMPROVED BIND-FREE, EXPANDABLE STRUCTURAL FRAME

BACKGROUND OF THE INVENTION

1. Field of the Invention

The present invention relates generally to prefabricated, adjustable frame assemblies such as door frames, window frames, and the like and more particularly, to an expandable structural frame member the adjustability feature of which is facilitated by a slide mechanism having loose fitting telescoping channels and in which at least one of the channels in any single frame member is dimpled to assure accurate lateral registry of the component parts of the frame member.

2. Prior Art

Adjustable frame structures wherein the adjustability feature is provided for varying the width of the structure such as for permitting a door frame to vary in width for different size bucks, is well-known in the art. By way of example, U.S. Pat. No. 4,395,855 discloses an expandable door frame which uses a combination of jamb pieces, clips and slide guides to permit adjustment of the width of a door frame so that the overall width of the jamb corresponds with the wall thickness of the door opening.

U.S. Pat No. 3,906,671 discloses an adjustable door frame which includes parallel side jambs and a head jamb extending between the side jambs. Depressed areas form protuberances projecting from the rear of the clip. The depressed areas are matched by cut-outs in the legs in an opposing section so that the respective sections can be adjusted while maintaining them in rigid configuration and in an aligned positional relation.

U.S. Pat. No. 2,651,814 is directed to a door frame which provides a pair of adjustable coacting wedge members extending transversely between the outer edges of the door jamb sections and the studding defining the door opening. The wedge members have inclined side faces which define strips which slideably fit one against another so that the wedge members may be moved longitudinally while being forced outwardly relative to one another.

U.S. Pat. No. 2,853,161 is directed to an adjustable frame provided with a plurality of spaced ratchet guide members each having a plurality of one-way ratchet teeth. The ratchet guide members are substantially channel-shaped and have backs secured to the inside of a door jamb surface. The ratchet guide members provide means for securing the frames in a particular width configuration depending upon the installation required.

U.S. Pat. No. 1,050,924 is directed to a door or window frame which provides for alignment between corresponding members by means of threading members into recesses giving an adjustable-type system.

Although each of the aforementioned prior art adjustable frames, as well as other adjustable frames that may be known in the art, provide an advantageous feature, namely, adjustability for varying the width in response to variations in the dimensions or surrounding structure, they unfortunately also suffer from a disadvantage which complicates frame assembly and installation. Such prior art requires the addition of labor associated with the complexity of installation which tends to defeat the otherwise advantageous adjustability feature. More specifically, the structures of the prior art tend to require precise alignment of the adjustable members relative to one another during the assembly process and still tends to produce a binding of coacting members which makes accurate adjustment substantially more difficult as well as significantly more time-consuming, thereby increasing the cost of assembly and at least partially defeating the otherwise advantageous feature of adjustability.

There is therefore a need to provide an expandable frame structure such as in the form of door frames and window frames and the like which, although being adjustable to accommodate different buck widths, is implemented utilizing interconnecting members which are readily aligned without difficulty and which may be easily adjusted relative to one another without binding. Such a frame structure must still provide a simple and expedient means for assuring accurate lateral registry of the relative adjustable members thereby permitting installers to take full advantage of the adjustability feature of such devices but without incurring the time-consuming difficulties associated with the prior art devices.

SUMMARY OF THE INVENTION

The present invention provides an improved expandable frame structure which solves the aforementioned need by permitting adjustability in a frame structure which is more readily assembled while obviating the time-consuming binding problem of the prior art and while still assuring lateral registry of the interfacing structural members of the frame system. A preferred embodiment of the invention is disclosed herein in the form of a roll formed steel door frame assembly comprising a plurality of pairs of L-shaped sections that fit together during the frame assembly process to form the vertical and header members of the door frame, each such member being characterized by a novel slide mechanism. The slide mechanism comprises interfitting tongue and channel members adapted to fit together relatively loosely for allowing substantial ease of alignment and adjustability thereby avoiding the problems associated with the prior art devices.

In a typical embodiment configured as a door frame assembly, each vertical member of the frame is provided with four such slide mechanisms and the header is provided with two such slide mechanisms. One of the two slide mechanisms in the header and one of the four slide mechanisms in each of the vertical members of the frame, provides a channel member which is dimpled along the sides thereof, as will be described in more detail hereinafter, to provide a precise means for accurately registering the L-shaped portions of each frame member despite the otherwise loose fitting association of the various slide mechanisms. Consequently, the novel adjustable frame system of the present invention overcomes the aforementioned prior art problems associated with binding and other difficulties and assembly of the frame while still assuring proper alignment and registry of the frame subcomponents whereby to assure easy assembly with a minimum expenditure of associated labor. Furthermore, the novel slide mechanism of the present invention is of a relatively simple geometry which may be readily affixed to the L-shaped portions of the various frame members by means of riveting, welding or the like and without requiring any substantial modification to the inherent shape of the frame members. Consequently, the present invention has virtually no impact upon the cost of the various components of the frame assembly other than the minimal cost of the slide mechanisms themselves which may be readily manufactured using standard readily available steel plate bending machinery.

OBJECTS OF THE INVENTION

It is therefore a principal object of the present invention to provide an improved bind-free, expandable frame structure in the form of door frames, window frames and the like and which substantially reduces or entirely overcomes the noted deficiencies of the prior art.

It is an additional object of the present invention to provide an improved adjustable frame structure each member of which utilizes a plurality of slide mechanisms comprising loosely interlocking tongue and channel members for overcoming the binding problems associated with prior art devices.

It is still an additional object of the present invention to provide an improved bind-free, expandable frame structure which may be readily assembled at the construction site and is adjustable for accommodating different buck widths of surrounding structural members while still providing means for assuring precise transverse registry of the interfacing components of each frame member.

It is still an additional object of the present invention to provide an improved bind-free, expandable frame structure for door frames, window frames and the like, each such frame having one or more frame members comprising a pair of elongated L-shaped portions interconnected by a plurality of slide mechanisms which permit easy increase or decrease in the buck width of the frame with little likelihood of binding or incurring other adjustment difficulties during assembly.

BRIEF DESCRIPTION OF THE DRAWINGS

The aforementioned objects and advantages of the present invention, as well as other objects and advantages thereof, will become more apparent as a result of a detailed description of a preferred embodiment of the invention when taken in conjunction with the following drawings in which.

DETAILED DESCRIPTION OF A PREFERRED EMBODIMENT

Figure 1:
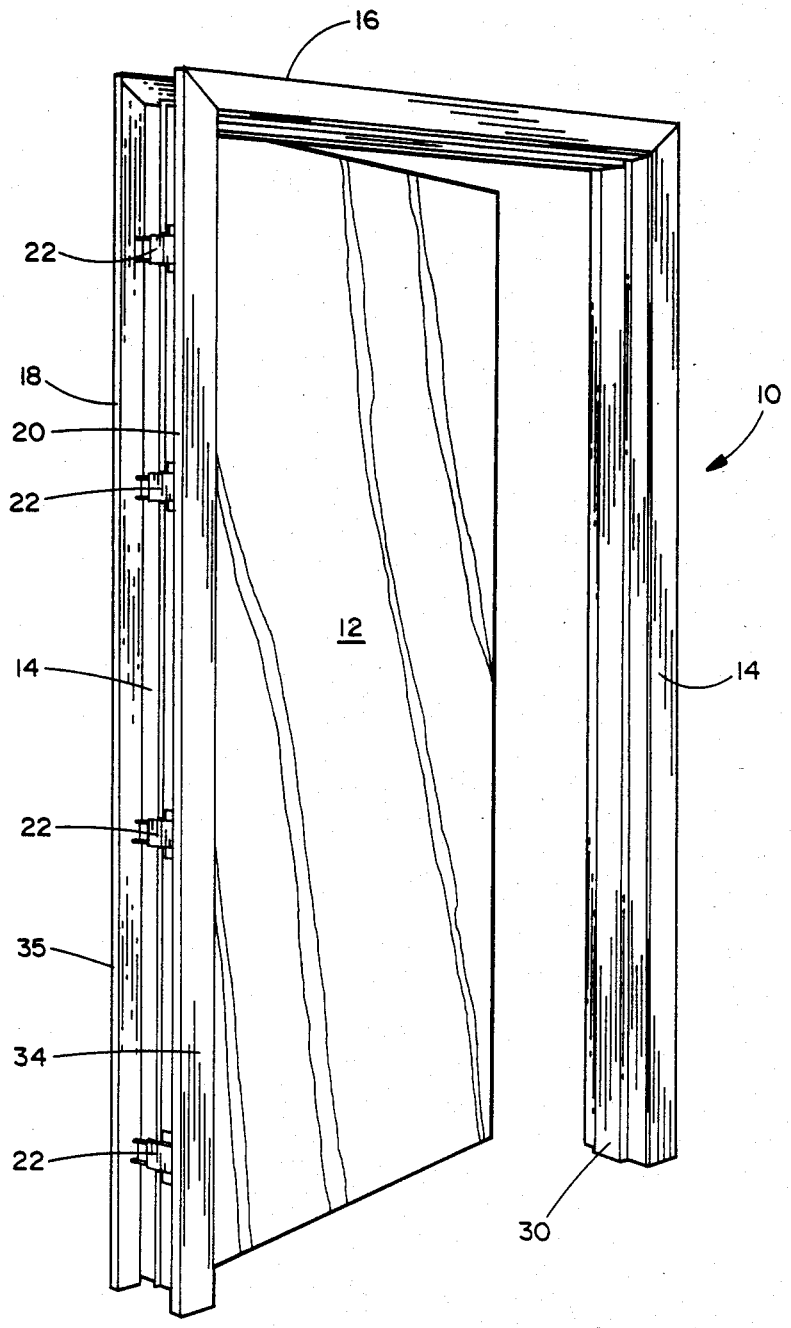
FIG. 1 is a three-dimensional view of a door frame assembly of the invention.

Referring first to FIG. 1, it will be seen that a typical frame assembly 10 of the present invention may be configured as a door frame for supporting a conventional door 12. In this configuration frame assembly 10 comprises a pair of vertical members 14 and a header member 16. Each of the vertical members and the header member comprise a first L-shaped portion 18 and a second L-shaped portion 20.

The two L-shaped portions 18 and 20 are designed to interconnect in order to both abut and straddle the wall structure defining the opening into which the door frame is to be installed. The width of the door frame 10 is adjustable, that is, the distance between for example, molding 34 of L-shaped portion 20 and molding 35 of L-shaped portion 18 is variable to accommodate different wall thicknesses for the adjacent structure. This adjustability feature is provided by slide mechanisms 22, a plurality of which are provided in each of the vertical members 14 and the header member 16. More specifically, in the particular embodiment illustrated in FIG. 1 for example, each vertical member 14 comprises four such slide mechanisms 22 and the header member 16 comprises two such slide mechanisms 22.

Figure 2:
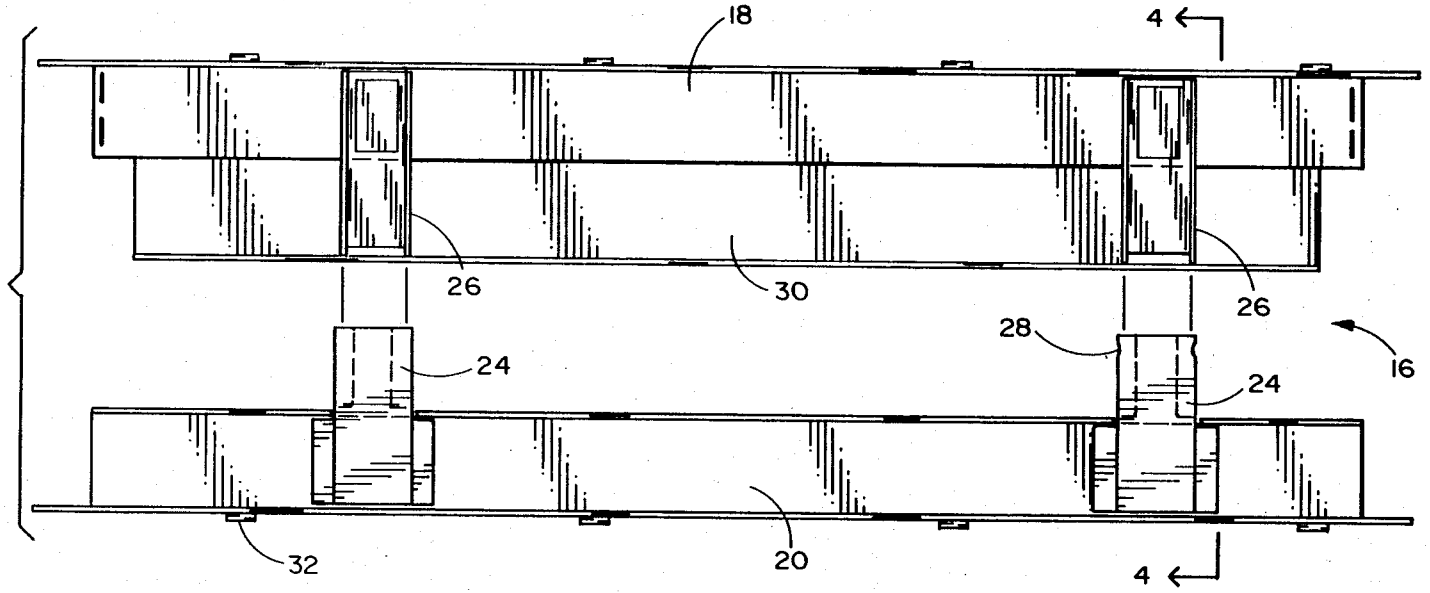
FIGS. 2 and 3 are top views of the header portion of the door frame of FIG. 1 illustrating the L-shaped portions thereof in disassembled and assembled configurations, respectively.
Figure 3:
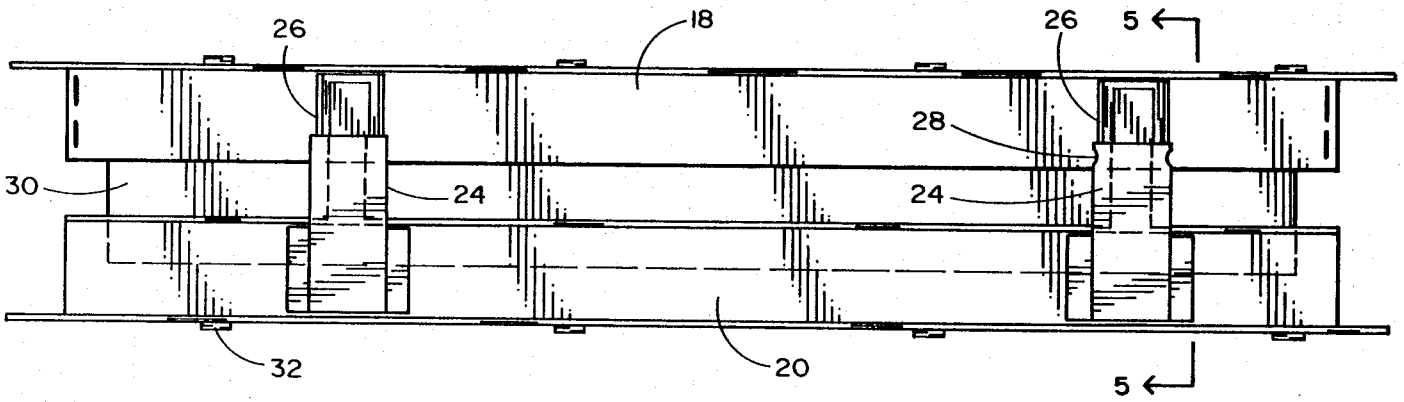
Figure 4:
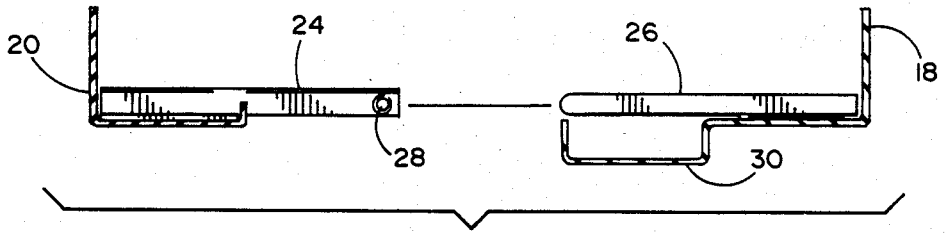
FIG. 4 is a cross-sectional view taken along lines 4—4 of FIG. 2.
Figure 5:
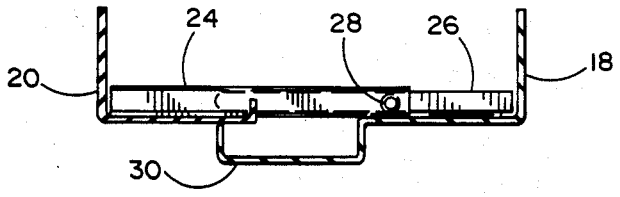
FIG. 5 is a cross-sectional taken along lines 5—5 of FIG. 3.
Figure 6:
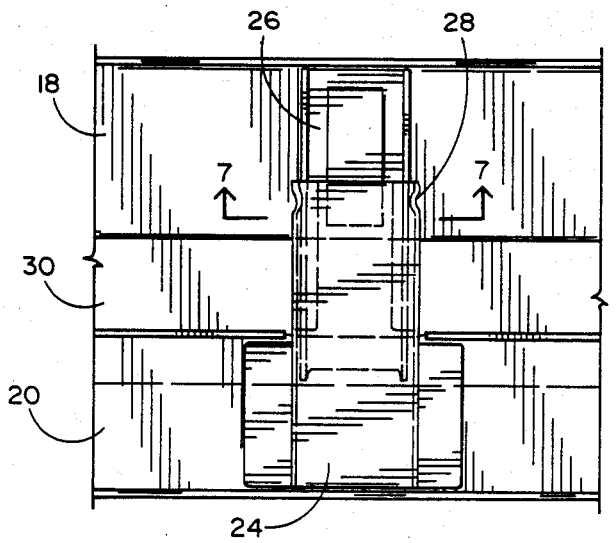
FIG. 6 is an enlarged plan view of one interconnected slide mechanism of the present invention.
Figure 7:
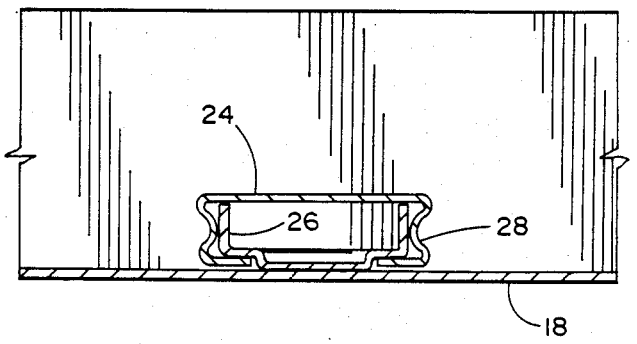
FIG. 7 is a cross-sectional view taken along lines 7—7 of FIG. 6.
Figure 8:
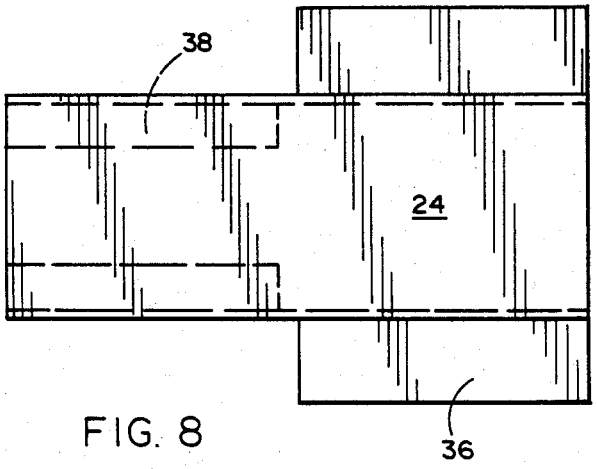
FIGS. 8–10 are further enlarged top, front and end views respectively, of the channel member of the invention.
Figure 10:
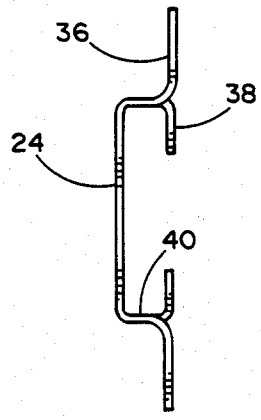
Figure 9:
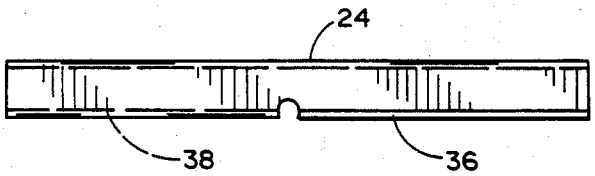
Figure 11:
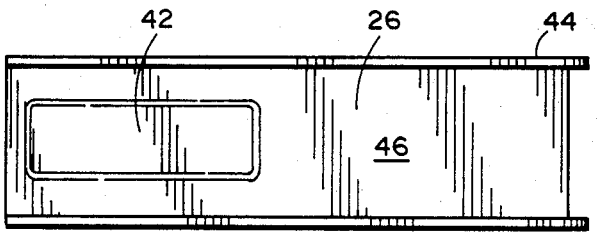
FIGS. 11–13 are equally enlarged top, front and end views respectively, of the tongue member of the invention.
Figure 13:
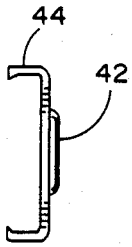
Figure 12:
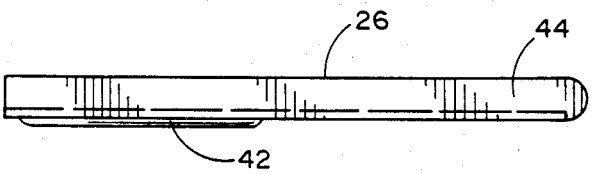

Slide mechanisms 22 and their interaction with the L-shaped portions upon which they are mounted, may be better understood by referring to FIGS. 2 and 3. More specifically, FIG. 2 illustrates the L-shaped members 18 and 20 in their disconnected configuration and FIG. 3 illustrates the L-shaped portions 18 and 20 in their fully connected configurations and adjusted to have the minimum separation for minimum door width. As seen in FIGS. 2 and 3 each slide mechanism 22 comprises a channel member 24 and a tongue member 26. It will be understood that although the header member 16 is illustrated in FIGS. 2 and 3, the configuration of the vertical members 14 is substantially identical except that there are four slide mechanisms 22 instead of just the two shown in FIGS. 2 and 3.

It will be observed in FIGS. 2 and 3 that of the two slide mechanisms 22 shown therein, one and only one has a channel member 24 which provides a pair of dimples 28 the purpose of which is to assure precise transverse registration between first L-shaped portion 18 and second L-shaped portion 20 of each member, despite the relatively loose interfitting relationship between each channel member 24 and corresponding tongue member 26. The loose fitting relationship between each channel member 24 and its corresponding tongue member 26 assures adjustability of the L-shaped portions relative to one another to vary the width of the member by either increasing or decreasing the distance between the L-shaped portions but without incurring the binding problem associated with the prior art as previously discussed. Ordinarily the loose fitting relationship would incur the disadvantage of permitting some lateral movement between the L-shaped portions 18 and 20 thereby rendering the door frame less precise in its geometrical configuration which might otherwise interfere with the assembly of the door. Fortunately however, this problem is solved by having one channel member on each L-shaped portion 20 of the respective vertical members and the header member dimpled as shown best in FIGS. 2 and 3 whereby to substantially prevent any lateral movement between the L-shaped portions. However, it is to be understood that it is only necessary to have one such channel member so dimpled to accomplish this purpose. Furthermore, because the dimple 28 is virtually only a point as opposed to an elongated surface, it does not reintroduce the binding problem solved by the loose fitting relationship between the channel members and the corresponding tongue members.

The particular embodiment of the invention shown herein for purposes of illustration, employs a first L-shaped portion 18 which includes a door jamb 30 and both L-shaped portions 18 and 20 provide a plurality of spaced clips 32 each such plurality being adapted to receive the molding 34 or 35 previously referred to in conjunction with FIG. 1. However, it will be understood that the present invention relates primarily to the slide mechanisms 22 including the use of a plurality of such slide mechanisms to secure two structural members to one another in relative slideable engagement and wherein lateral registry of the two such members is attained by providing at least one such sliding mechanism with dimples as depicted in FIGS. 2 and 3. Accordingly, it will be understood that the particular configuration of the L-shaped portions 18 and 20, including the provision of a door jamb 30 and clips 32 for receiving molding 34 and 35, respectively, is not deemed to be limiting of the scope of the present invention.

The sliding operation of channel member 24 and tongue member 26 of each slide mechanism 22 may be best understood by referring to FIGS. 4–7. The geometrical configuration of the respective channel and tongue members may be best understood by reference to FIGS. 8–13. As seen in these figures, channel member 24 is a substantially rectangular body of elongated configuration having a C-shaped cross-section and comprising a pair of interface flanges 36 and a pair of channel flanges 38, the latter defining an elongated channel 40 for receiving all or a portion of the tongue member 26. Tongue member 26 is also a rectangular elongated C-shaped member, in this instance having an interface recess 42 of generally rectangular configuration and a pair of wall flanges 44 extending the full length of the tongue member. Interface flanges 36 of channel member 24 and interface 42 of tongue member 26 serve substantially the same purpose, namely, to provide a suitable surface for permitting each attachment of the respective members to their respective L-shaped portions 18 and 22. Such interconnection may be accomplished by riveting, welding and the like, virtually any conventional means for securing one cold rolled steel member to another being suitable for use in the present invention.

The channel flanges 38 of channel member 24 are designed to define the path for but loosely enclose the tongue member 26 and specifically the wall flanges thereof as well as an interconnecting planar portion 46 thereof. The preferred shape and relative dimensions of the dimple 28 of a channel member 24 are seen best in FIG. 7 wherein it is shown that the circular dimple 28 comprises a substantially concave depression in the exterior wall surface of channel member 24, the innermost point thereof being substantially contiguous with the wall flanges 44 of tongue member 26. In practice, it has been found best to provide dimples 28 in only one of the channel members 24 associated with the various slide mechanisms 22 of a particular member such as each particular vertical member 14 or the header member 16 in the door frame 10. By limiting the dimpling to just one such slide mechanism 22, a limited degree of rotation is possible between the respective L-shaped portions 18 and 20 whereby to provide an additional degree of freedom not generally available in the prior art. This additional degree of freedom renders it substantially more likely that the assembler will be able to easily adjust the L-shaped portions relative to one another to accommodate virtually any width required within the range of the slide mechanism 22, while entirely avoiding the prior art disadvantage of binding and other such limitations of movement that cause difficulties as previously described.

It will now be apparent to those having skill in the art to which the present invention pertains that what has been disclosed herein comprises a novel, adjustable frame structure of improved design which overcomes binding and other similar difficulties of assembly found in prior art devices. The improvement resides in a unique slide mechanism a plurality of which is provided on each elongated member of the frame assembly. At least one such slide mechanism of each such plurality is provided with at least one and preferably two dimples to assure proper transverse registry of L-shaped portions making up the elongated member while still permitting an otherwise loose fitting arrangement between the interfitting components of the slide mechanism. The slide mechanism comprises a channel member and a tongue member the relative dimensions of which permit a degree of rotation as well as longitudinal sliding therebetween whereby to significantly reduce the difficulties of adjustment therebetween.

As a result of the applicant's teaching herein it will now become apparent to those having skill in the art to which the present invention pertains, that various modifications and additions may be made thereto. By way of example, slide mechanisms having different dimensions and configurations may be provided while still incorporating the significant improvement of having a loose fitting relationship therebetween and providing only such slide mechanism on each elongated member with a means for assuring transverse lateral registry of the elements thereof such as the dimples herein disclosed. However, it will be understood that all such modifications and additions are deemed to be within the scope of the invention which is to be limited only by the claims appended hereto.

I claim:

1. An improved frame assembly such as for use as a door or window frame and of the type having a plurality of elongated frame members, each such frame member having relatively movable portions for adjustment of the width of the frame assembly to accommodate different buck widths during installation; the improvement comprising:

at least two slide mechanisms associated with each such frame member, each such slide mechanism comprising a channel member affixed to one of said movable portions and a tongue member affixed to another of said movable portions, each said channel member and respective tongue member being in opposed loosely fitting relative alignment for adjustable sliding engagement therebetween without binding, the channel member of at least one of said slide mechanisms having means for substantially eliminating transverse movement of a tongue member relative to the engaging channel member whereby to assure proper lateral registry of said movable portions to one another;

each said tongue member being configured to slide longitudinally within a corresponding channel member in a direction parallel to said buck width; and wherein said means for substantially eliminating transverse movement comprises a dimpled depression in a channel member, the axis of said depression being substantially perpendicular to said parallel direction.

2. The improvement recited in claim 1 wherein said dimpled depression is generally of a circular concave shape.

3. The improvement recited in claim 1 wherein all of the components of said frame assembly are made of metal.

4. The improvement recited in claim 3 wherein said metal is roll formed steel.

5. An improved elongated structural member of the type having a pair of elongated L-shaped members adapted for variable separation for adjusting the width of said structural member; the improvement comprising:

at least two spaced apart slide mechanisms, each having a channel member affixed to one of said L-shaped members and a tongue member affixed to the other of said L-shaped members, said channel member and said tongue member being in opposed, loosely fitting, relative alignment for adjustable sliding engagement therebetween without binding;

the channel member of at least one of said slide mechanisms having means for substantially eliminating transverse movement of a corresponding engaging tongue member whereby to assure precise lateral registry of said L-shaped portions;

each said tongue member being configured to slide longitudinally within a corresponding channel member in a direction parallel to said buck width; and wherein said means for substantially eliminating transverse movement comprises a dimpled depression in a channel member, the axis of said depression being substantially perpendicular to said parallel direction.

6. The improvement recited in claim 5 wherein said dimpled depression is generally of a circular concave shape.

7. The improvement recited in claim 5 wherein all of the components of said structural member are made of metal.

8. The improvement recited in claim 7 wherein said metal is roll formed steel.

* * * * *